United States Patent [19]

Fenne

[11] 4,201,160

[45] May 6, 1980

[54] FUEL INJECTION SYSTEMS

[75] Inventor: Ivor Fenne, Greenford, England

[73] Assignee: Lucas Industries Limited, Birmingham, England

[21] Appl. No.: 905,515

[22] Filed: May 12, 1978

[30] Foreign Application Priority Data

Jun. 9, 1977 [GB] United Kingdom ..... 24207/77

[51] Int. Cl.[2] ..... F02B 3/00

[52] U.S. Cl. ..... 123/32 G; 123/139 AJ

[58] Field of Search ..... 123/32 G, 139 AJ

[56] References Cited

U.S. PATENT DOCUMENTS 3,627,208 12/1971 Scott ..... 123/32 G

FOREIGN PATENT DOCUMENTS 792775 4/1958 United Kingdom ..... 123/32 G

*Primary Examiner*—Ronald B. Cox

[57] ABSTRACT

A fuel injection system for supplying fuel to a combustion space of an internal combustion engine includes a fuel injection nozzle having a fuel inlet and outlets which direct fuel into the combustion space. A piston is provided within a cylinder one end of which is subjected to the pressure within the combustion space. The other end of the cylinder communicates with the inlet of the nozzle and a valve is provided whereby a fuel injection pump is held out of communication with the inlet of the nozzle until the piston has moved inwardly under the action of rising pressure within the combustion chamber. During the inward movement fuel is displaced by the piston to the nozzle and this is supplied as a pilot quantity of fuel to the combustion space.

9 Claims, 2 Drawing Figures

FUEL INJECTION SYSTEMS

Figure 1:
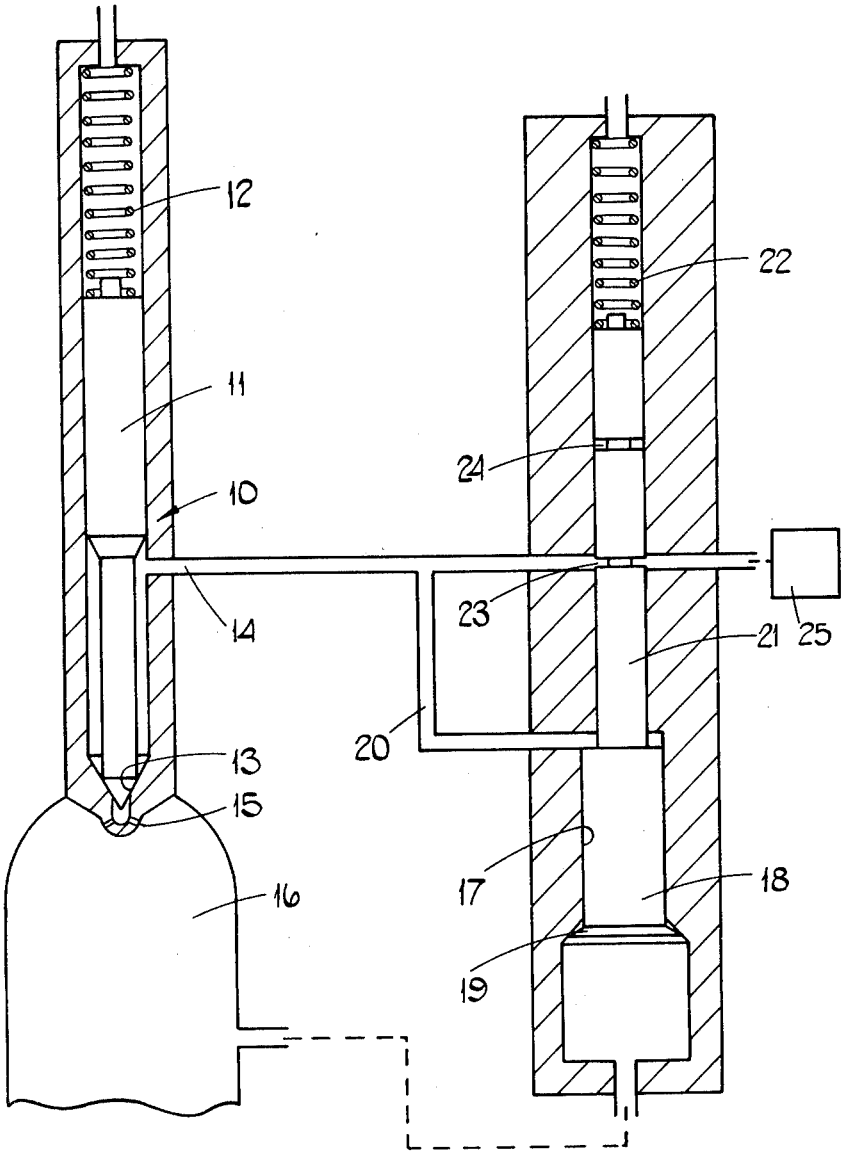

This invention relates to a fuel injection system for supplying fuel to a combustion space of a reciprocating piston internal combustion engine more particularly a diesel engine, the system comprising a fuel injection nozzle having a fuel inlet and including a valve member movable by fuel under pressure to an open position to allow fuel to flow into the combustion space and resilient means for moving said valve member to a closed position, the system further including a fuel pump for supplying fuel under pressure to said inlet of the nozzle in timed relationship with the associated engine and means whereby a small quantity of fuel can be supplied to the combustion space through the nozzle, in advance of the main quantity of fuel supplied by the pump.

When a quantity of fuel is supplied to the combustion space of a compression ignition engine there is a delay following the first introduction of fuel, before combustion starts. During this period a considerable quantity of fuel can be supplied and the result is that when combustion does start there is a rapid rise in the pressure within the combustion space giving rise to the so called diesel "knock". It is a well known technique to introduce a small quantity of fuel into the combustion space to ensure so far as is possible, that combustion has started before the main quantity of fuel is introduced. In this manner the rate of increase of pressure is reduced resulting in quieter operation of the engine.

Various systems for providing the initial quantity of fuel have been described. In general these modify the fuel flow through the nozzle whilst fuel is being supplied thereto by the pump. In one system the flow of fuel to the nozzle is initially at a restricted rate until a valve has operated to allow flow at the normal rate. In another system a valve operates after an initial flow of fuel to temporarily halt the flow of fuel from the pump by closing a supply passage to the nozzle, the fuel which is delivered by the pump being stored whilst in another system the fuel is allowed to flow to a drain.

Such systems have not proved to be very successful in practice because the conditions of operation are very severe. For example the operating pressure is very high and pressure waves occur in the pipeline connecting the pump and nozzle which tend to upset the operation of the valves.

The object of the invention is to provide a system of the kind specified in a simple and convenient form.

According to the invention in a system of the kind specified said means comprises a piston slidable within a cylinder, said cylinder having an inlet at one end for connection in use to the combustion space of the engine, an outlet from the other end of said cylinder connected to the inlet of the nozzle and valve means operable by said piston, said valve means being interposed between the fuel pump and the inlet of the nozzle and being arranged to be closed until said piston is at or adjacent said other end of the cylinder, the arrangement being such that the piston is moved to said other end of the cylinder during the compression of air within the combustion space, such movement acting to displace fuel from said other end of the cylinder to the injection nozzle and the combustion space to initiate combustion therein, the main quantity of fuel being supplied by the pump to the nozzle when said valve means has operated to place the pump in communication with the inlet of the nozzle.

Two examples of systems in accordance with the invention will now be described with reference to the two drawings, the drawings being diagrammatic representations.

With reference to FIG. 1 of the drawings there is indicated at 10, an injection nozzle of a conventional type and which comprises a stepped valve member 11 which is biassed by a coiled compression spring 12 so that the shaped end of the valve member is held in sealing engagement with a seat 13. A fuel inlet 14 is provided and outlet orifices 15 are also provided. When the valve member is lifted from its seating, fuel from the inlet 14 flows through the orifices into a combustion space indicated at 16 of a compression ignition engine. The valve member in the usual manner is lifted against the action of the spring 12 by the fuel under pressure which is supplied to the inlet 14.

Also provided is a cylinder 17 in which is located a piston 18. One end of the cylinder is in communication with the combustion space 16 and conveniently the piston 18 is provided with a head 19 which engages with a step to form a seal when the piston member has been moved by the pressure of air within the combustion space as will be described. The other end of the cylinder communicates by way of a passage 20 with the inlet 14 and extending from the piston 18 is a valve member 21. The piston 18 and valve member 21 are biassed by a coiled compression spring 22 towards said one end of the cylinder 17 and the valve member is provided intermediate its ends, with a pair of circumferential grooves 23, 23. Moreover, formed in the wall of the bore in which the valve member is mounted is a pair of aligned ports positioned to be placed in communication with each other by the aforesaid grooves when the piston is in one or the other of its extreme positions. The ports communicate with the inlet 14 and the outlet of a fuel pump 25 respectively.

The fuel pump 25 is a conventional high pressure fuel pump actuated in timed relationship with the associated engine and it will include means for controlling the amount of fuel supplied to the injection nozzle.

In the position shown in the drawings, the aforesaid ports are in communication with each other by means of the groove 23 and this is the condition in which fuel supplied by the pump 25 flows to the nozzle and to the combustion space of the engine. The fuel is burned within the combustion space and the associated piston partakes of its power stroke moreover, the delivery valve in the pump will have reduced the fuel pressure in the various passages to the residual pressure again as is usual with this type of apparatus. At the end of the power stroke the pressure within the combustion space decreases and the spring 22 moves the valve member 21 and piston 18 towards said one end of the cylinder 17. During this movement a certain volume of fuel can flow into the other end of the cylinder 17 although this volume will be comparatively small. When however the groove 24 is brought into register with the ports, a further flow of fuel into the other end of the cylinder occurs from the pipe line interconnecting the pump and nozzle. There is therefore a further reduction in the residual pressure. The one end of the cylinder will however be completely filled with fuel. During the next compression stroke the pressure in the combustion space rises and the piston 18 will be moved by this pressure against the action of the spring 22. During this movement fuel is displaced from the other end of the cylinder and flows by way of the passage 20 to the inlet 14 of the nozzle. The fuel pressure generated is sufficiently high to effect opening of the nozzle and a small quantity of fuel is supplied to the combustion space of the engine to initiate combustion therein. When the pistons has moved its maximum extent the aforesaid ports are placed in communication with each other by the groove 23 and therefore the pump 25 can supply the main quantity of fuel to the nozzle. It should be noted also that the head 19 of the piston engages with its seating to minimise the possible contamination of the wall of the cylinder 17 by products of combustion.

The quantity of fuel which is initially injected is determined by the displacement of the piston 18. This will be substantially constant. The valve member 21 is integral with the piston 18 so that only an annular portion of the end face of the piston effects pumping. This face is also exposed to the high pressure which is generated by the pump and therefore the ratio of the end surfaces of the piston must be carefully chosen to ensure that the piston is not moved during the delivery of fuel towards said one end of the cylinder.

Figure 2:
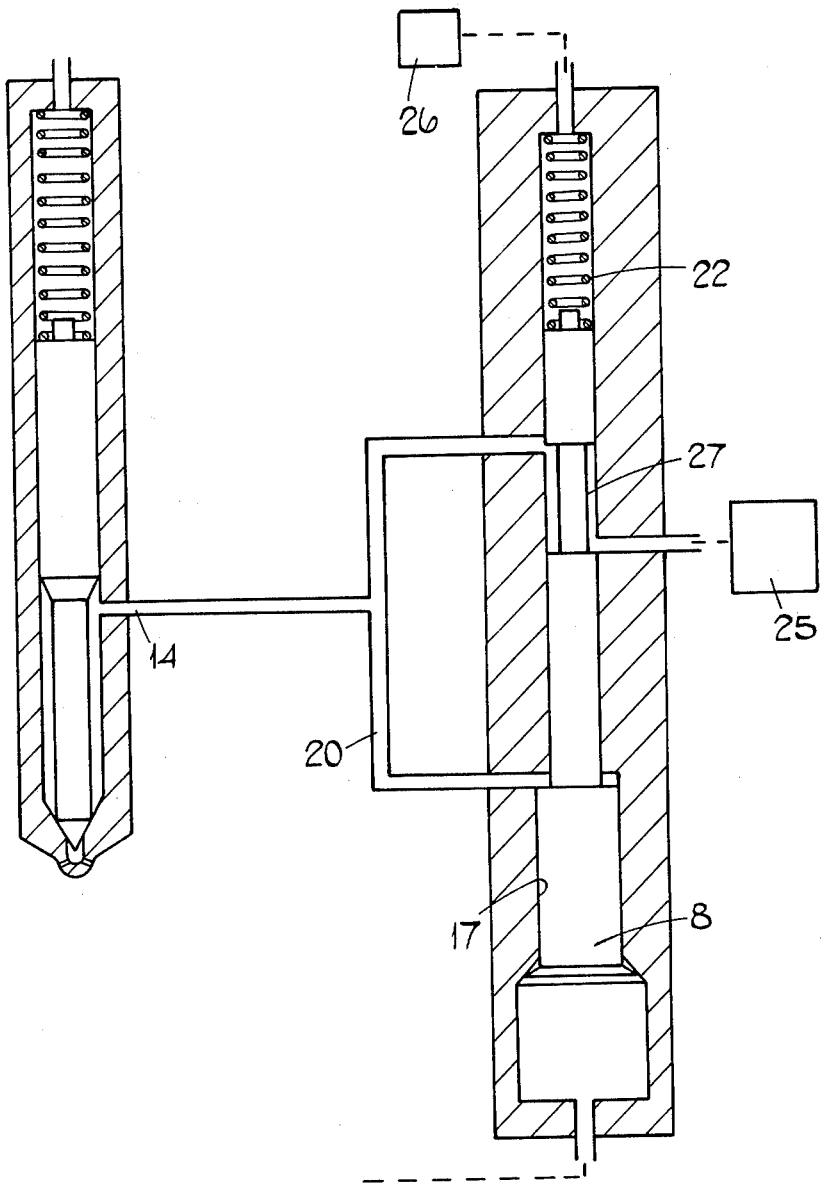

Turning now to FIG. 2 it was mentioned in relation to FIG. 1 that the fuel forming the initial quantity of fuel was derived mainly from the pipeline interconnecting the pump 25 and the nozzle. This resulted in a lowering of the residual pressure. In some systems the pipeline may be extremely short such that it is unable to supply the required volume of fuel. This problem is overcome in the arrangement shown in FIG. 2. In FIG. 2 the aforesaid ports are laterally displaced but when the piston 18 is at said other end of the cylinder the two ports are interconnected by a groove 27 of the increased axial length as compared with the groove 23. The groove 24 as such is omitted but it is arranged that when the piston 18 is at said one end of the cylinder the port which communicates with the inlet 14 of the pump is exposed to the end of the bore containing the spring 22. This end of the bore is in communication with a source of fuel indicated at 26. With this arrangement therefore when the air pressure within the combustion space has lowered sufficiently to allow the piston and valve member to move to said one end of the cylinder the inlet 14 and passage 20 is placed in communication with the low pressure source of fuel whilst at the same time the port which communicates with the pump 25 is open only to the groove 27. Hence the initial quantity of fuel is mainly derived from the source 26 and there is practically no lowering of the residual pressure.

The systems as described have the advantage over the prior art systems that the valve is operated by the air pressure within the combustion space and its operation is not in any way affected by the high fuel pressure delivered by the injection pump or by any pressure waves which may be generated when the fuel pump 25 delivers fuel.

What is claimed is:

1. A fuel injection system for supplying fuel to a combustion space of a reciprocating piston internal combustion engine more particularly a diesel engine, the system comprising a fuel injection nozzle having a fuel inlet and including a valve member movable by fuel under pressure to an open position to allow fuel to flow into the combustion space and resilient means for moving said valve member to a closed position, the system further including a fuel pump for supplying fuel under pressure to said inlet of the nozzle in timed relationship with the associated engine, means whereby a small quantity of fuel can be supplied to the combustion space through the nozzle in advance of the main quantity of fuel supplied by the pump, said means comprising a piston slidable within a cylinder, said cylinder having an inlet at one end for connection in use to the combustion space of the engine, an outlet from the other end of said cylinder connected to the inlet of the nozzle and valve means operable by said piston, said valve means being interposed between the fuel pump and the inlet of the nozzle and being arranged to be closed until said piston is at or adjacent said other end of the cylinder, the arrangement being such that the piston is moved to said other end of the cylinder during the compression of air within the combustion space, such movement acting to displace fuel from said other end of the cylinder to the injection nozzle and the combustion space to initiate combustion therein, the main quantity of fuel being supplied by the pump to the nozzle when said valve means has operated to place the pump in communication with the inlet of the nozzle.

2. A system according to claim 1 in which the area of the end of the piston subjected to the pressure within the combustion chamber is less than the area of the piston which displaces fuel to the injection nozzle.

3. A system according to claim 2 including resilient means biassing the piston towards said one end of the cylinder.

4. A system according to claim 3 in which said valve means includes a valve member formed by an extension of reduced cross sectional area, of the piston, a bore in which the valve member is slidable and co-operating ports and grooves in the bore and piston.

5. A system according to claim 4 in which the difference between the cross sectional area of the piston and the valve member represents the area of the piston which displaces fuel to the nozzle.

6. A system according to claim 5 in which said area is an annular area.

7. A system according to claim 4 in which the valve member defines a pair of spaced grooves and the bore defines a pair of axially aligned ports, one of said ports communicating with the outlet of the pump and the other port communicating with the inlet of the fuel injection nozzle, said ports being placed in communication with each other by said grooves at the ends respectively of the travel of the piston.

8. A system according to claim 4 in which the valve member is provided with a circumferential groove, the bore defining a pair of axially spaced ports, the first port furthest from the cylinder being in communication with the inlet of the injection nozzle and the port nearer to the cylinder being in communication with the pump, the ports being placed in communication with each other by way of said groove when the piston is at said other end of the cylinder and said first port being exposed by the remote end of the valve member to the bore when the piston is at said one end of the cylinder, and a low pressure source of fuel communicating with said bore.

9. A system as claimed in any one of the preceding claims in which the end of the piston which is subject to the pressure within the combustion chamber is provided with a head for co-operation with a seating defined at the entrance of the cylinder, said head co-operating with said seating when the piston is at said other end of the cylinder.

* * * * *